United States Patent [19]

Dennis

[11] Patent Number: 4,676,758

[45] Date of Patent: Jun. 30, 1987

[54] COMBINED CUTTER AND BYPASS FOR PROPELLER

[75] Inventor: Timothy A. Dennis, Winter Haven, Fla.

[73] Assignee: Dennis Propellers, Inc., Winter Haven, Fla.

[21] Appl. No.: 775,259

[22] Filed: Sep. 12, 1985

[51] Int. Cl.[4] ..... B63H 1/28

[52] U.S. Cl. ..... 440/73; 440/89; 416/93 A; 416/146 B

[58] Field of Search ..... 440/71, 73, 89; 416/93 R, 93 A, 146 R, 146 B

[56] References Cited

U.S. PATENT DOCUMENTS

| | | | |
|---|---|---|---|
| 1,813,540 | 7/1931 | Laska | 416/146 B |
| 3,467,051 | 9/1969 | Shimanckas | 416/146 B |
| 4,276,036 | 6/1981 | Nishida et al. | 440/89 |
| 4,331,429 | 5/1982 | Koepsel et al. | 440/89 |

FOREIGN PATENT DOCUMENTS

| | | | |
|---|---|---|---|
| 543903 | 3/1942 | United Kingdom | 440/89 |

*Primary Examiner*—Trygve M. Blix
*Assistant Examiner*—Thomas J. Brahan
*Attorney, Agent, or Firm*—Frijouf, Rust & Pyle

[57] ABSTRACT

A motor-driven marine propeller is disclosed for propelling a marine vessel. The propeller includes a hub member driven by the motor and a can member disposed coaxially relative to the hub member the can member having a fore and an aft end. The hub member and the can member define therebetween an annular port for the passage therethrough of a portion of the exhaust generated by the motor. Supports extend between the hub member and the can member for supporting the can member coaxially relative to the hub member and a plurality of blades are secured to and extend from the can member with each of the blades being equidistantly spaced relative to each other. Each of the blades defines a leading and a trailing surface such that the propeller rotates in a direction from the trailing towards the leading surface in normal forward motion. A plurality of notches are defined by the fore end of the can member and each of the notches is disposed adjacent to a trailing surface of an adjacent blade such that the notches cut through filamentary material entangled around the propeller and reduce the generation of eddies during rotation of the propeller.

22 Claims, 5 Drawing Figures

COMBINED CUTTER AND BYPASS FOR PROPELLER

BACKGROUND OF THE INVENTION

1. Field of the Invention

This invention relates to a motor-driven marine propeller for propelling a marine vessel or the like. More specifically, this invention relates to a marine propeller having a can for the passage therethrough of exhaust generated by the motor.

2. Information Disclosure Statement

Can-type propellers have been used extensively for propelling high speed motor boats, particularly boats used in bass fishing tournaments. Can-type propellers include a central hub driven by an outboard motor. A can disposed coaxially with the central hub is connected to the hub by radially extending webs and the exhaust generated by the motor is directed through the annular port defined by the hub and the can. A plurality of blades, usually three, extend substantially radially from the can such that as the hub is driven by the motor, rotational movement is transmitted to the can and attached blades by means of the radially extending webs.

While some cans are essentially cylindrical, the aft end of the can on some can propellers is flared ouwardly on the outer can surface or the inner can surface or both such that as the propeller rotates for providing forward motion to the boat there exists a tendency to decrease pressure in the water behind the aft end of the can thereby assisting the scavenging of gaseous exhaust from the fore to the aft end of the can.

However, with the aforementioned prior art propellers, as the blades rotate in the water, eddies are generated in the vicinity of the trailing surfaces of the blades. Consequently, proposals have been developed in which a portion of the exhaust is directed through holes in the fore end of the can such that this portion of the exhaust will flow along the trailing surface of the blades and assist the smooth flow of water from the fore to the aft end of the can.

An example of the aforementioned proposal in which a portion of the exhaust is bypassed is disclosed in U.S. Pat. No. 3,788,267 to Strong.

U.S. Pat. No. 3,788,267 teaches that cavitation most often occurs in high speed propellers and discusses the effects of polishing the blades. However, this disclosure emphasizes that due to mass production adequate polishing is not always possible. Part of the exhaust is permitted to pass through axially spaced holes thereby enabling the inhibition of cavitation bubbles on the surfaces of the blades.

Another problem encountered by high speed motor boats is the entanglement of water weeds around the propeller.

U.S. Pat. No. 4,080,099 to Snyder teaches a plurality of weedcutting fingers radially offset from the propeller shaft for cutting entangled weeds.

Although the prior art propellers have, to a degree, avoided cavitation bubbles, and cutting devices have been proposed for cutting entangled weeds and fishline and the like, the present invention not only combines these characteristics but also provides an improved configuration which enhances performance and efficiently cuts through entangling weeds. Therefore, it is a primary object of this invention to provide a marine propeller that overcomes the aforementioned inadequacies of the prior art devices and provides an improvement which significantly contributes to the overall performance of a marine propeller or the like.

Another object of the present invention is the provision of a marine propeller having a plurality of notches defined by the fore end of the can member, each of the notches being disposed adjacent to a trailing surface of an adjacent blade thereby enhancing relief of exhaust gas and assisting the smooth flow of water from the fore to the aft end of the can member.

Another object of the present invention is the provision of a marine propeller in which each of the notches is triangular in configuration with the triangular configuration being right angled to include a first edge which extends substantially parallel to the axis of rotation of the propeller for cutting through filamentary material entangled around the propeller.

Another object of an alternate embodiment the present invention is the provision of a marine propeller in which each of the notches is in the form of a slot substantially parallel to the root portion of the adjacent blade for cutting through filamentary material entangled around the propeller.

Another object of the present invention is the provision of a marine propeller in which the apex of each of the plurality of notches enables part of the exhaust to pass along the trailing surface of an adjacent blade rearwardly across the outer surface of the can member towards the aft end of the can member and towards the leading surface of an approaching blade during rotation of the propeller thereby reducing the generation of eddies and assisting in the displacement of fluid in front of each leading blade surface of the propeller.

Another object of the present invention is the provision of a marine propeller in which the fore end of the can member defines an annular lip which is of reduced thickness relative to the thickness of the remainder of the can member such that the annular lip cooperates with an exhaust conduit of the motor such that a portion of the exhaust is conducted past the lip and through the annular port defined by the hub and the can member.

The foregoing has outlined some of the more pertinent objects of the present invention. These objects should be construed to be merely illustrative of some of the more prominent features and applications of the invention. Many other beneficial results can be obtained by applying the disclosed invention in a different manner or modifying the invention within the scope of the disclosure. Particularly, with regard to the use of the invention disclosed herein, it should not be construed as being limited to propellers for marine application, but should include any propeller rotating within a fluid. More particularly, the term "marine propeller" should not be taken to limiting the use of such propeller for propelling boats through the sea or ocean but should include propellers for use in fresh water lakes, rivers and the like.

SUMMARY OF THE INVENTION

The marine propeller of the present invention is defined by the appended claims with a specific embodiment shown in the attached drawings. For the purpose of summarizing the invention, the invention relates to a marine propeller for propelling a marine vessel. The propeller includes a hub member driven by the motor and a can member disposed coaxially relative to the hub member, the can member having a fore and an aft end. The hub member and the can member define therebetween an annular port for the passage therethrough of a portion of the exhaust generated by the motor. A support means extends between the hub member and the can member for supporting the can member coaxially relative to the hub member and a plurality of blades are secured to and extend from the can member with each blade being equidistantly spaced relative to each other. A root portion of each blade is disposed adjacent to the can member and extends substantially from the fore to the aft end of the can member. Each of the blades defines a leading and a trailing surface such that the propeller rotates in a direction from the trailing towards the leading surface in normal forward motion. A plurality of notches are defined by the fore end of the can member and each of the notches of the plurality of notches is disposed adjacent to a trailing surface of an adjacent blade.

In a more specific embodiment of the present invention, the hub member includes a first hub sleeve which defines a splined bore, and a second sleeve disposed coaxially relative to the first hub sleeve such that the first hub sleeve extends through the second hub sleeve. An elastomeric bushing extends between and is disposed coaxially relative to the sleeves such that the bushing yieldably transmits rotational movement of the first hub sleeve to the second hub sleeve.

The can member is substantially cylindrical in configuration and may be flared outwardly towards the aft end of the can member for assisting the flow of exhaust gas from the fore towards the aft end of the can member, thereby generating a vortex flox configuration when the propeller is rotated. The fore end of the can member defines an annular lip which is of reduced thickness relative to the thickness of the remainder of the can member such that the annular lip cooperates with an exhaust conduit of the motor so that a portion of the exhaust is conducted past the lip and through the annular port.

The support means extends between the hub member and the can member and includes a plurality of webs with each web extending radially from the hub member towards the can member. Each web is secured to the can member in the preferred embodiment adjacent to a fore end of the root portion of a blade such that the number of webs corresponds to the number of blades.

In a preferred embodiment of the present invention, the propeller includes a first, second and third blade, each of the blades having substantially the same configuration and dimensions and in which each of the blades extends outwardly and rearwardly away from the can member in a direction from the fore to the aft end of the can member such that the blades extend rearwardly from the can member past the aft end of the can member.

Each notch of the plurality of notches is formed in the can member with each notch being positioned in the fore end of the can member substantially adjacent to the trailing surface of an adjacent blade. The fore end of the can member further includes a rim edge wherein each notch of the plurality of notches extends from the rim edge into the can member.

Each of the notches in the fore end of the can member in a preferred embodiment is located adjacent to the trailing surface of a blade and is substantially triangular in configuration. The triangular configuration is right angled with the hypotenuse extending substantially parallel to the root portion of the adjacent blade. Each notch defines a first edge which extends substantially parallel to the axis of rotation of the propeller for cutting through filamentary material entangled around the propeller. Furthermore, the apex of each of the notches enables part of the exhaust to pass along the trailing surface of the adjacent blade rearwardly across the outer surface of the can member towards the aft end of the can member and towards the leading surface of an approaching blade during rotation of the propeller in normal forward motion, thereby reducing the generation of eddies and assisting in the displacement of fluid in front of each leading surface of the propeller.

In an alternative embodiment, each of the notches is substantially in the form of a slot located adjacent to the trailing edge of a blade and substantially parallel to the root portion of the adjacent blade. The slot may have a flared opening at the fore end of the can. The leading edge of the slot is substantially parallel to the root portion of the adjacent blade, while a first segment of the trailing edge is substantially parallel to the leading edge and joined thereto at an apex of the slot. The remainder of the trailing edge of the slot may continue to the fore end of the can in a direction substantially parallel to the leading edge of the slot, or the remainder of the trailing edge of the slot may form a second segment substantially parallel to the axis of rotation of the propeller, thus producing a flared opening in the fore end of the can. In this alternative embodiment, the first segment of the trailing edge of the slot, which is substantially parallel to the leading edge of the slot, is preferably approximately one-half the length of the leading edge of the slot, and the flared opening has a dimension roughly one half the length of the leading edge of the slot.

The foregoing has outlined rather broadly the more pertinent and important features of the present invention in order that the detailed description that follows may be better understood so that the present contribution to the art can be more fully appreciated. Additionally, features of the inventions will be described hereinafter which form the subject of the claims of the invention. It should be appreciated by those skilled in the art that the conception and the specific embodiment disclosed may be readily utilized as a basis for modifying or designing other devices for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
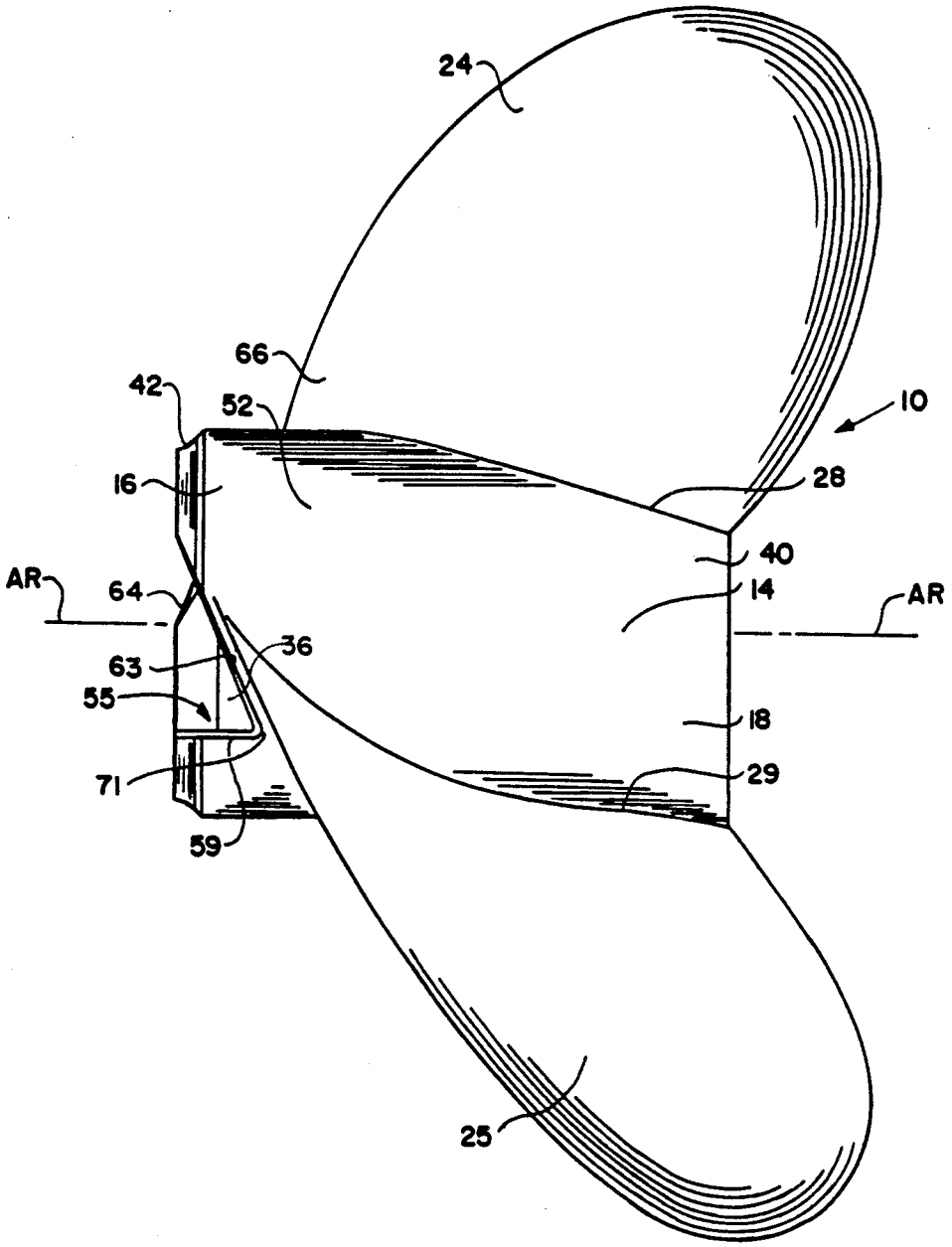
FIG. 1 is a side elevational view of a marine propeller according to a preferred embodiment of the present invention.
Figure 2:
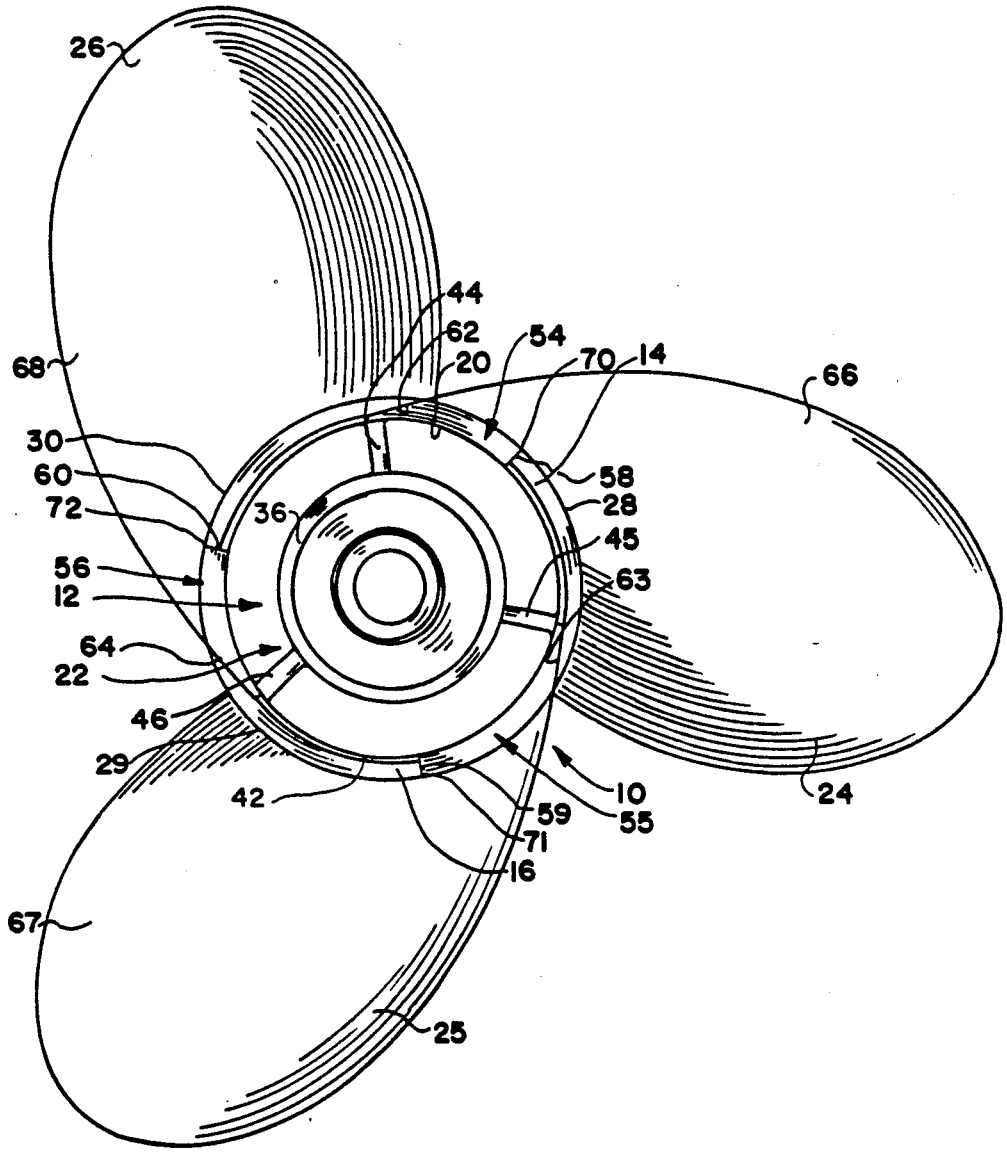
FIG. 2 is a front elevational view of the propeller shown in FIG. 1 viewed from the fore end of the can member.
Figure 3:
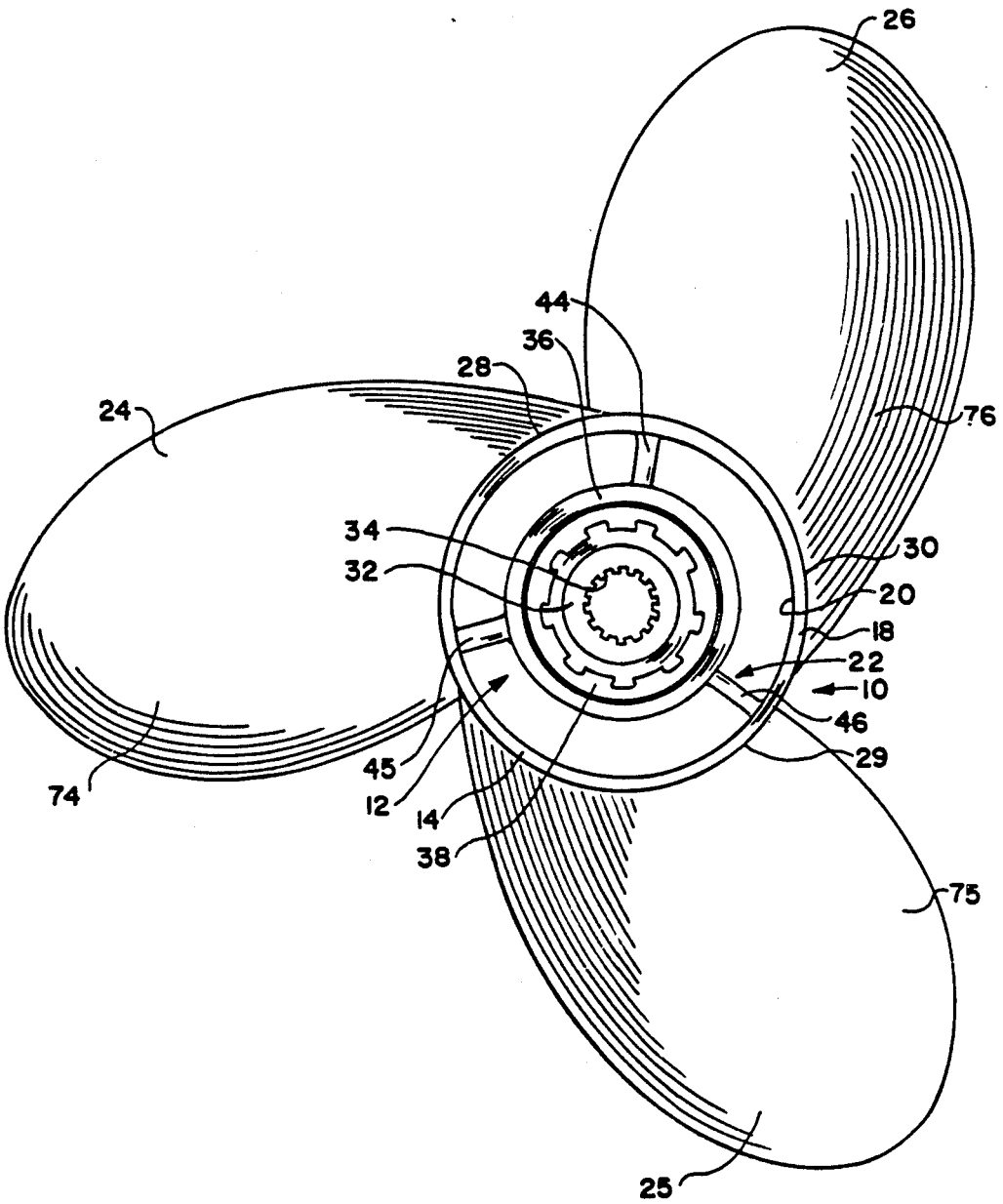
FIG. 3 is a rear end view of the propellers shown in FIG. 1 and FIG. 4 viewed from the aft end of the can member.

FIG. 1 is a side elevational view of a marine propeller generally designated 10 for propelling marine vessel. The propeller 10 includes a hub member generally designated 12 as shown in FIGS. 2 and 3 driven by a motor. A can member 14 is disposed coaxially relative to the hub member 12, the can member 14 having a fore and an aft end 16 and 18 respectively. The hub member 12 and the can member 14 define therebetween an annular port 20 shown more particularly with reference to FIGS. 2 and 3 for the passage therethrough of a portion of the exhaust generated by the motor. Support means generally designated 22 extend between the hub member 12 and the can member 14 for supporting the can member 14 coaxially relative to the hub member 12. A plurality of blades 24, 25, and 26 are secured to and extend from the can member 14 with each of the blades 24, 25 and 26 being equidistantly spaced relative to each other. A root portion 28, 29 and 30 of each blade 24, 25 and 26 respectively is disposed adjacent to the can member 14 such that the root portions 28–30 extend substantially from the fore end 16 to the aft end 18 respectively of the can member 14.

FIG. 3 shows the propeller 10 viewed from the aft end 18 of the can member 14 and shows the blades 24–26 extending from the can member 14.

More specifically, as shown particularly with reference to FIG. 3, the hub member 12 also includes a first hub sleeve 32 which defines a splined bore 34. A second hub sleeve 36 is disposed coaxially relative to the first hub sleeve 32 such that the first hub sleeve 32 extends through the second hub sleeve 36. An elastomeric bushing 38 extends between and is disposed coaxially relative to the sleeves 32 and 36 such that the bushing 38 yieldably transmits rotational movement of the first hub sleeve 32 to the second hub sleve 36.

As shown particularly in FIG. 1, the can member 14 is substantially cylindrical in configuration with the aft end 18 of the can member 14 including an outward flare 40 for assisting the flow of exhaust from the fore towards the aft end 16 and 18 respectively of the can member 14. The flared aft end 18 of the can member 14 generates a vortex configuration within the water when the propeller 10 is rotated, and the resulting low pressure region tends to enhance scavenging of the exhaust. The fore end 16 of the can member 14 defines a annualar lip 42 which is of reduced wall thickness relative to the thickness of the remainder of the can member 14. The annular lip 42 cooperates with an exhaust conduit (not shown) of the motor such that a portion of the exhaust is conducted past the lip 42 and through the annular port 20.

As shown with reference to FIGS. 2 and 3, the support means 22 includes a plurality of webs 44, 45 and 46 with each web extending radially from the hub member 12 towards the can member 14. Each of the webs 44–46 is secured to the can member 14 adjacent to the fore end 16 of each of the root portions 28 and 30 respectively such that the number of webs 44–46 corresponds to the number of blades 24–26.

Preferably, the propeller 10 includes a first, second and third blade 24, 25 and 26 with each of the blades 24–26 having substantially the same configuration and dimensions. As shown with reference to FIG. 1, each of blades 24–26 extends outwardly and rearwardly away from the can member 14 in a direction from the fore to the aft end 16 and 18 respectively of the can member 14 such that the blades 24–26 extend rearwardly from the can member 14 past the aft end 18 of the can member 14 with each of the blades 24–26 extending from the external surface 52 of the can member 14.

An important feature of the present invention includes a plurality of V-shaped or triangular notches generally designated 54, 55 and 56 defined by the can member 14 towards the fore end 16 of the can member 14. These notches 54–56 are equidistantly spaced around the fore end 16 of the can member 14. Each of the notches 54–56 are identical in configuration and dimensions and include an edge 58, 59 and 60 respectively disposed substantially parallel to the axis of rotation AR of the propeller 10 such that when the propeller 10 rotates, the edges 58–60 tend to cut through filamentary material entangled around the can member 14.

The triangular shaped notches 54–56 as shown in FIG. 2 also include sides 62, 63 and 64 respectively which constitute the hypotenuse of the triangular configuration. The sides 62–64 are disposed substantially parallel to and adjacent to the trailing surfaces 66, 67 and 68 respectively of the blades 24–26 as shown in FIGS. 1 and 2. As shown in FIG. 1, the side 63 of the notch 55 is disposed adjacent to the trailing surface 67 of the blade 25. Not only do the edges 58–60 of the triangular shaped notches 54–56 assist in cutting through entangled filamentary material, but also these notches 54–56 which correspond in number to the number of blades of the propeller permit passage of part of the exhaust from the annular port 20 towards the respective apices 70, 71 and 72 of the notches 54–56 and onwards towards the trailing surfaces 66–68 of the blades 24–26. This part of the exhaust follows the external surface 52 of the can member 14 and is approached by an adjacent blade as the blades 24–26 rotate. Therefore, part of the exhaust flows from the annular port 20 through the notches 54–56 towards the apices 70–72 along the trailing surfaces 66–68 across the external surface 52 of the can member 14 and toward leading surfaces 74, 75 and 76 shown in FIG. 3 of the blades 24–26 respectively. This flow of part of the exhaust tends to inhibit the formation of eddies adjacent to the external surface 52 of the can member 14 thereby increasing the free flow and displacement of fluid ahead of the leading surfaces 74–76 of each blades 24–26 as the blades rotate. This feature in combination with the outward flare 40 at the aft end 18 of the can member 14 reduces the tendency to cavitation in the vicinity of the propeller 10 and therefore enhances the "hole shot" or "standing start" performance of the propeller.

Figure 4:
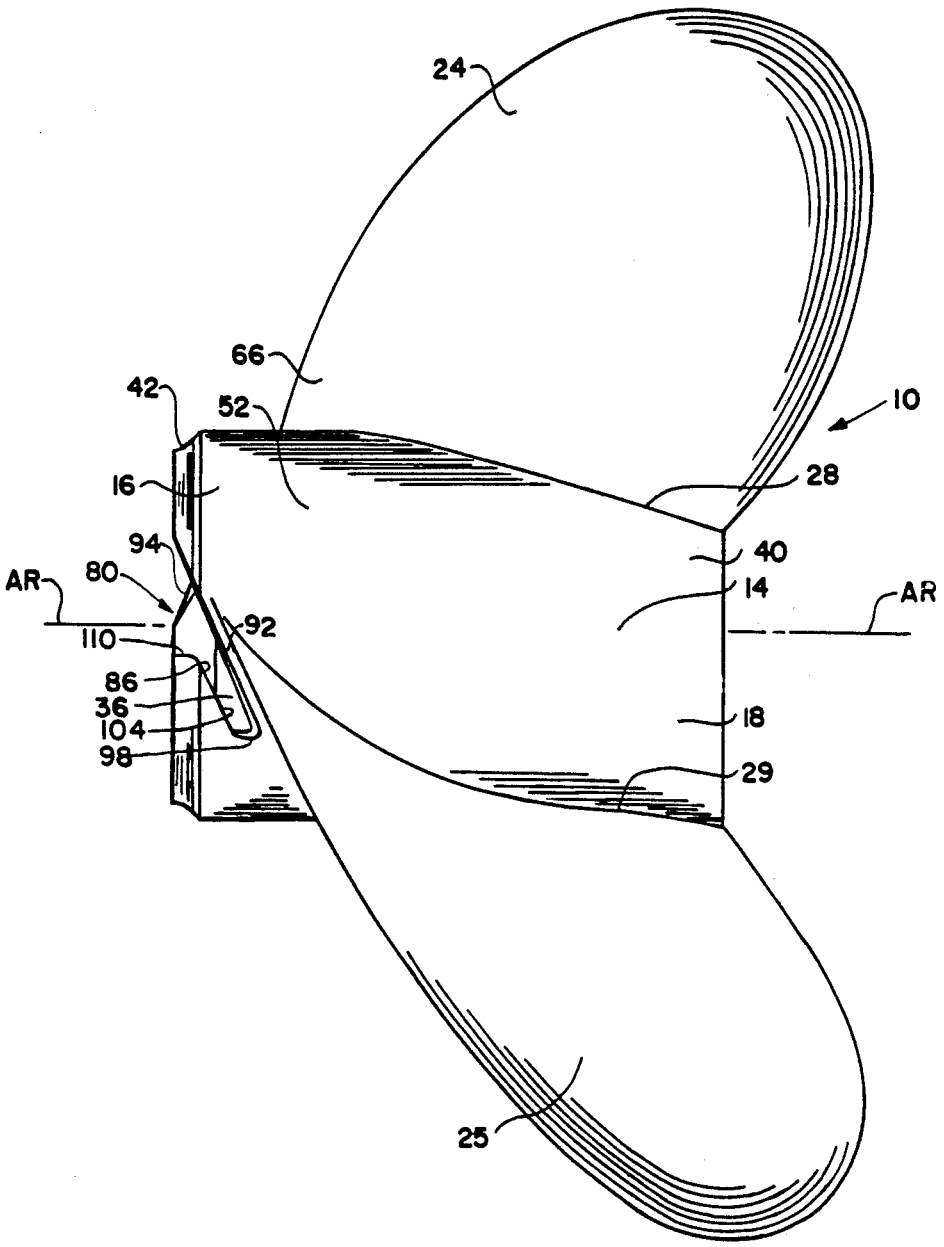
FIG. 4 is a side elevational view of an alternative embodiment of a marine propeller according to the present invention.
Figure 5:
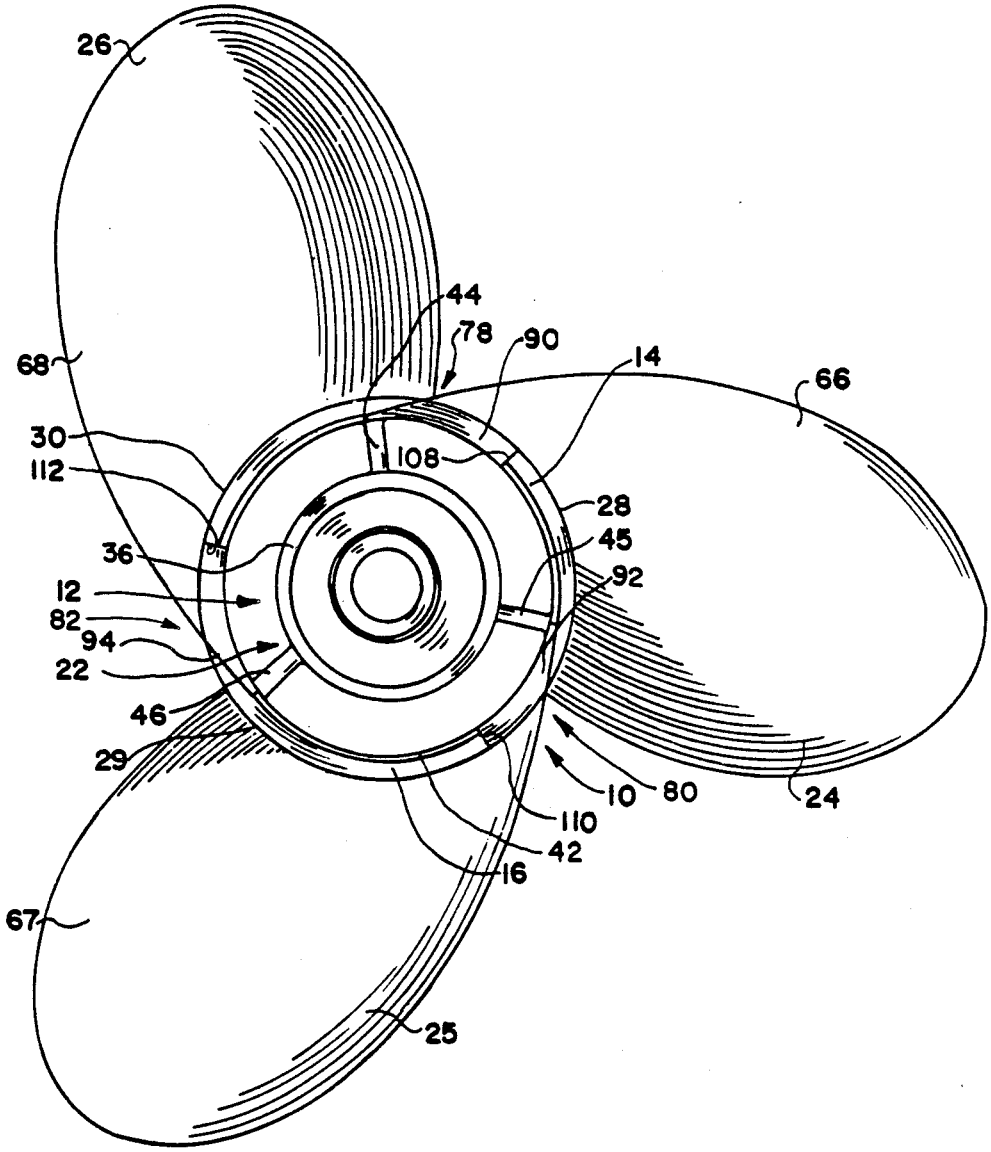
FIG. 5 is a front elevational view of the propeller shown in FIG. 4 viewed from the fore end of the can member.

An alternative embodiment of the present invention is shown in FIGS. 4 and 5 of the drawings. This alternative embodiment differs from that design described above only in the shape of the notches which are located at the fore end of the can adjacent to the trailing surface of each blade. As shown particularly in FIG. 4, the notch of the alternative embodiment is in the form of a slot genrally designated 80 which has a trailing edge 86 comprising a first segment 104 and a second segment 110. Slot 80 is also defined by leading edge 92 joined to the first segment 104 at the apex 98. Leading edge 92 of slot 80 (and of each of the plurality of slots) is substantially parallel to the root portion of the adjacent blade (not visible in FIG. 4). The trailing edge 86 of slot 80 may be substantially parallel to leading edge 92 and to the root portion of the adjacent blade, or the trailing edge 86 may have a first segment 104 as shown in FIG. 4 which is substantially parallel to leading edge 92 and roughly half the length of leading edge 92. Trailing edge 86 may also comprise a second segment 110 which is substantially parallel to the axis of rotation AR of the propeller, thus forming a slot 80 with a flared opening at the fore end 16 of can member 14.

FIG. 5 shows the front elevational view of the alternative embodiment with the three flared openings of slots 78, 80 and 82 respectively visible on the fore end 16 of can member 14 adjacent to the trailing surfaces of the blades of the three-bladed propeller shown for purposes of illustration. Also visible in this view is the forward portion of the slot leading edges 90, 92 and 94 respectively. Notches cut in the form of the slots as described in FIGS. 4 and 5 have been found to be quite effective both in the relief of the motor exhaust and reduction of cavitation problems as well as in the cutting of filamentary material such as aquatic plants and fishing line which may occasionally become entangled in the propeller.

In operation of the propeller according to the present invention, when the propeller is rotated in a counter clockwise direction when viewed as shown in FIGS. 2 and 5, the notches not only serve to cut entangled filamentary material from around the can member but also serve the purpose of reducing cavitation in the vicinity of the propeller.

The present invention provides a propeller which meets all the optimum characteristics required particularly by competition bass fishermen and also provides an improved stability and controlability of the craft to which such propeller is fitted.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A motor driven marine propeller for propelling a marine vessel, said propeller comprising:

a hub member driven by the motor;

a can member disposed coaxially relative to said hub member, said can member having a fore end and an aft end;

said hub member and said can member defining an annular port therebetween for the passage therethrough of a portion of the exhaust generated by the motor;

support means extending between said hub member and said can member for supporting said can member coaxially relative to said hub member;

a plurality of blades, each of said blades being secured to and extending from said can member, each of said blades being equidistantly spaced relative to each other;

a root portion of each blade disposed adjacent to said can member and extending substantially from said fore end to said aft end of said can member;

each of said blades defining a leading surface and a trailing surface such that the propeller rotates in a direction from said trailing surface towards said leading surface in normal forward motion;

a plurality of notches with each notch of said plurality of notches formed in said can member and being disposed at said fore end of said can member substantially adjacent to said trailing surface of an adjacent blade such that said plurality of notches cut through filamentary material entangled around the propeller and reduce the generation of eddies during the rotation of the propeller.

2. A marine propeller as set forth in claim 1, wherein said each of said notches is substantially triangular in configuration.

3. A marine propeller as set forth in claim 2, wherein said triangular configuration is right angled, the hypotenuse extending substantially parallel to said root portion of said adjacent blade.

4. A marine propeller as set forth in claim 2, wherein said triangular configuration is right angled and includes:

a first edge extending substantially parallel to the axis of rotation of the propeller for cutting through filamentary material entangled around the propeller.

5. A marine propeller as set forth in claim 2, wherein each of said notches enables part of the exhaust to pass along said trailing surface of said adjacent blade, rearwardly across the outer surface of said can member towards said aft end of said can member and towards said leading surface of an approaching blade during said motion of the propeller thereby reducing the generation of eddies and assisting in the displacement of fluid in front of each leading surface of said blades of the propeller.

6. A marine propeller as set forth in claim 1, wherein said hub member defines a splined bore such that said hub member is driven by the motor.

7. A marine propeller as set forth in claim 1, wherein said hub member further includes:

a first hub sleeve which defines a splined bore;

a second hub sleeve disposed coaxially relative to said first hub sleeve such that said first hub sleeve extends through said second hub sleeve;

an elastomeric bushing extending between and disposed coaxially relative to said sleeves such that said bushing yieldably transmits rotational movement of said first hub sleeve to said second hub sleeve.

8. A marine propeller as set forth in claim 1, wherein said can member is substantially cylindrical in configuration.

9. A marine propeller as set forth in claim 8, wherein said aft end of said can member is flared outwardly for assisting the flow of exhaust from said fore end towards aft end of said can member.

10. A marine propeller as set forth in claim 8, wherein said fore end of said can member defines an annular lip which is of reduced thickness relative to the thickness of the remainder of said can member.

11. A marine propeller as set forth in claim 10, wherein said annular lip cooperates with an exhaust conduit of the motor such that said portion of the exhaust is conducted past said lip and through said annular port.

12. A marine propeller as set forth in claim 1, wherein said support means includes:

a plurality of webs, each web extending radially from said hub member towards said can member, each web being secured to said can member adjacent to a fore end of said rod portion of a blade such that the number of webs corresponds to the number of blades.

13. A marine propeller as set forth in claim 1, wherein said plurality of blades includes:

a first blade;

a second blade;

a third blade, each of said blades having substantially the same configuration and dimensions.

14. A marine propeller as set forth in claim 1, wherein each of said blades extends outwardly away from said can member and rearwardly away from said can member in a direction from said fore end to said aft end of said can member such that said blades extend rearwardly from said can member past said aft end of said can member.

15. A marine propeller as set forth in claim 1, wherein each of said notches is a slot substantially parallel to said root portion of said adjacent blade.

16. A marine propeller as set forth in claim 15, wherein a leading edge of said slot is substantially straight and substantially parallel to said root portion of said adjacent blade.

17. A marine propeller as set forth in claim 16, wherein a trailing edge of said slot is substantially straight and substantially parallel to said leading edge of said slot; and wherein said trailing edge is joined to said leading edge at an apex of said slot.

18. A marine propeller as set forth in claim 16, wherein a trailing edge of said slot has a first segment substantially parallel to said leading edge of said slot;

said first segment of said slot being joined to said leading edge of said slot at an apex of said slot;

a second segment connecting said first segment of said trailing edge of said slot with said fore end of said can member;

said second segment being substantially parallel to the axis of rotation of the propeller for enabling said trailing edge and said apex of said slot to cut through filamentary material entangled around the propeller.

19. A marine propeller as set forth in claim 18, wherein each of said slots enables part of said exhaust to pass along said trailing surface of said adjacent blade, rearwardly across the outer surface of said can member towards said aft end of said can member and towards said leading surface of an approaching blade during said motion of the propeller thereby reducing the generation of eddies and assisting in the displacement of fluid in front of each leading surface of said blades of the propeller.

20. A marine propeller as set forth in claim 19, wherein said plurality of blades includes:

a first blade;

a second blade;

a third blade, each of said blades having substantially the same configuration and dimensions.

21. A marine propeller as set forth in claim 20, wherein each of said blades extends outwardly away from said can member and rearwardly away from said can member in a direction from said fore end to said aft end of said can member such that said blades extend rearwardly from said can member past said aft end of said can member.

22. The motor driven marine propeller of claim 1 wherein said fore end of said can member further includes a rim edge wherein each notch of said plurality of notches extends from said rim edge into said can member.

* * * * *